United States Patent [19]

Germann

[11] Patent Number: 4,697,515

[45] Date of Patent: Oct. 6, 1987

[54] ROTARY MULTICOLOR PRINTING MACHINE FOR SIMULTANEOUS RECTO-VERSO PRINTING

[75] Inventor: Albrecht J. Germann, Würzburg, Fed. Rep. of Germany

[73] Assignee: De la Rue Giori S.A., Switzerland

[21] Appl. No.: 914,773

[22] Filed: Oct. 3, 1986

[30] Foreign Application Priority Data

Oct. 15, 1985 [CH] Switzerland ..... 4 439/85

[51] Int. Cl.[4] ..... B41F 5/16

[52] U.S. Cl. ..... 101/179; 101/176

[58] Field of Search ..... 101/179, 180, 176, 178, 101/181, 182

[56] References Cited

U.S. PATENT DOCUMENTS 3,630,426 12/1971 Rieger et al. ..... 226/177

FOREIGN PATENT DOCUMENTS 0092887 11/1983 European Pat. Off. ..... 101/181
0133328 2/1985 European Pat. Off. ..... 101/179
0132858 2/1985 European Pat. Off. ..... 101/182
2115790 10/1972 Fed. Rep. of Germany .
2033836 10/1979 Fed. Rep. of Germany ..... 101/182
0114058 6/1984 Japan ..... 101/179

*Primary Examiner*—Edgar S. Burr

*Assistant Examiner*—James A. Lisehora

*Attorney, Agent, or Firm*—Kane, Dalsimer, Kane, Sullivan and Kurucz

[57] ABSTRACT

The printing machine has two interacting blanket cylinders (1,2) which are each inked by several offset plate cylinders (5,12) and between which the paper (P) to be printed on both sides runs through. One of the blanket cylinders (2) is also in contact with a plate cylinder (8) carrying a collect printing plate which is inked in a multicolor manner by a further blanket cylinder (9). This blanket cylinder (9) receives the inks from several appropriately inked selective color inking cylinders (10). Also arranged between the two blanket cylinders (2,9), which are in contact with the plate cylinder (8) carrying the collect printing plate, is an adjustable and convertible plate cylinder (16) which, in a first working position, carries an offset plate and rests against the blanket cylinder (2) inked by the offset plate cylinders (12), whilst in a second working position it carries a selective color inking plate and rests against the blanket cylinder (9) inked by the selective color inking cylinders (10). Thus, it is possible to produce on one side of the paper a multicolor pattern which is made by means of two different printing processes and in which either the number of colors used in collect printing or the number of colors used in offset printing is selectively increased by one color.

3 Claims, 1 Drawing Figure

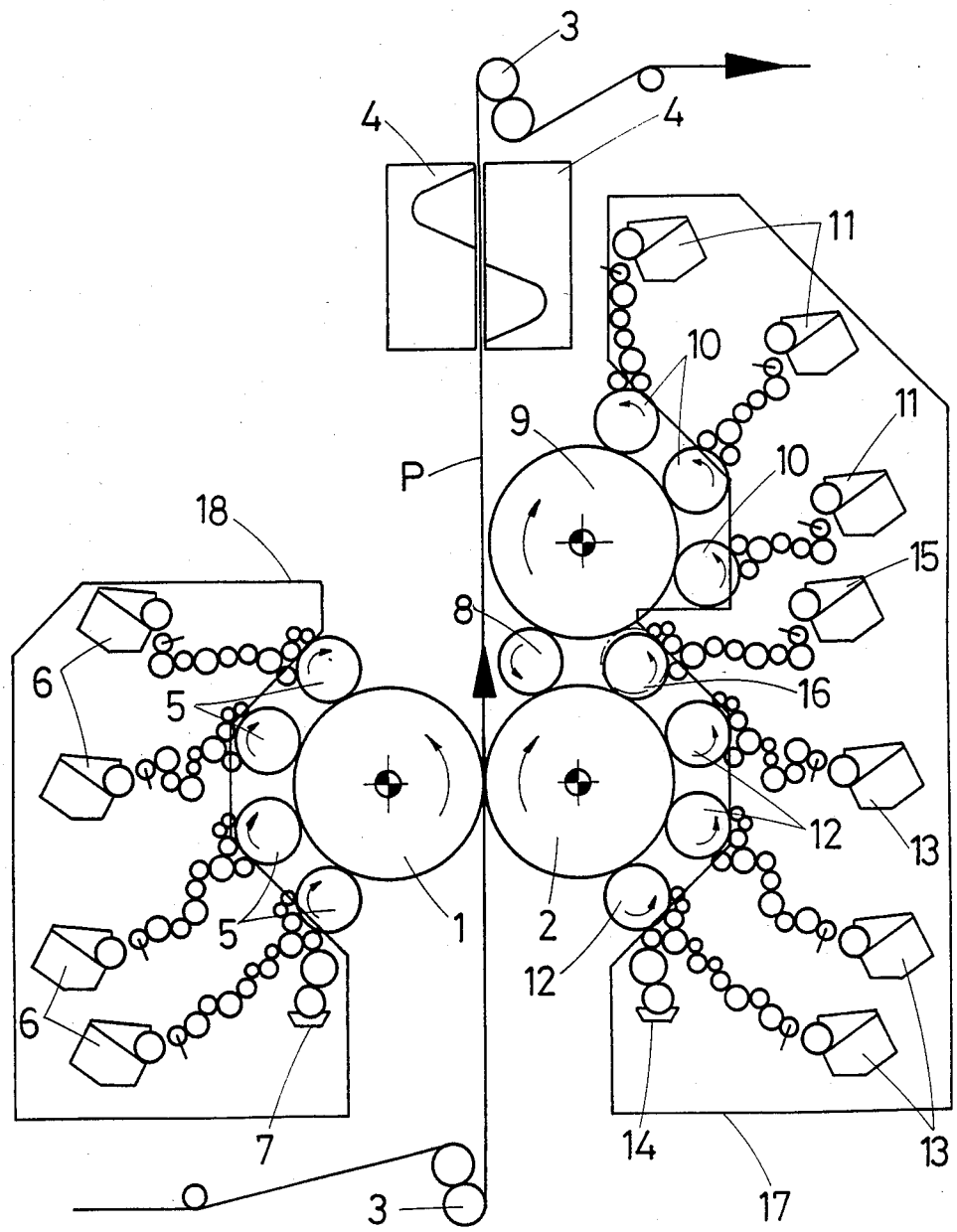
3
4
4
11
10
9
11
P
10
18
15
8
6
16
5
12
13
1
2
5
12
6
7
14
13
3
17

ROTARY MULTICOLOR PRINTING MACHINE FOR SIMULTANEOUS RECTO-VERSO PRINTING

FIELD OF THE INVENTION

The invention relates to a rotary multicolor printing machine for simultaneous recto-verso printing, especially for printing the safety background on banknotes, according to the preamble of patent claim 1.

PRIOR ART

A printing machine of this type is known from the European Patent Application under Publication No. 0,133,328 and makes it possible to use two completely different printing processes simultaneously in a single printing operation, because a multicolor pattern is printed on one side of the paper by means of the offset printing process, and at the same time a multicolor pattern is printed on the other side of the paper by means of the collect printing process, also called the "Orlof" process. Whereas the offset pattern consists of superimposed colors, the pattern produced by the collect printing process has colors located next to one another. This printing machine is especially suitable for banknote printing, since it makes it possible, in a single run, to print both sides of banknotes with a multicolor safety background obtained by different processes, thus increasing security against counterfeiting.

SUMMARY OF THE INVENTION

The object on which the invention is based is, on a printing machine of this type, to provide various possible combinations for the printing of multicolor patterns.

According to the invention, this object is achieved by means of the features indicated in patent claim 1. The process for operating this printing machine is indicated in patent claim 3.

The advantage of this printing machine is that, on the one hand, by means of the adjustable and convertible plate cylinder the number of colors used either in collect printing or in offset printing can be selectively increase by one color, and, on the other hand, the paper side printed according to the collect printing process additionally receives several offset prints. As a result, on the one hand the cost efficiency of the printing machine is increased since it allows different print combinations as required, and on the other hand, in banknote printing, a very high degree of security against counterfeiting is achieved since the multicolor pattern is produced on one and the same side of the banknote by means of two different printing processes.

An expedient arrangement of the three blanket cylinders of the machine which can preferably be a web-fed printing machine emerges from patent claim 2.

BRIEF DESCRIPTION OF THE DRAWINGS

The invention is explained in detail by means of the single FIGURE with reference to a diagrammatically illustrated exemplary embodiment of a web-fed printing machine.

DESCRIPTION OF THE PREFERRED EMBODIMENT

This web-fed printing machine has two blanket cylinders 1 and 2 which are mounted horizontally next to one another in the main frame of the machine and which are pressed against one another and form the nip for the paper web P to be printed on both sides. In the example under consideration, this paper web P running through between the blanket cylinders 1 and 2 moves vertically upwards in the direction of the arrow, is guided and tensioned by guide and tension rollers 3 and, after being printed, runs through a drying device 4 acting on both sides of the paper.

Four offset plate cylinders 5, each inked with different colors by an inking unit 6, rest against the blanket cylinder 1. In the example under consideration, the upper three plate cylinders 5 carry dry offset plates, that is to say typographic plates, whilst the lower plate cylinder 5, which inks the blanket cylinder 1 last during each revolution of the latter, carries a damp offset plate which is dampened by a damping unit 7. This damp offset plate is preferably a gravure plate.

A plate cylinder 8 rests against the blanket cylinder 2 and carries a collect printing plate. This is a typographic plate which carries a design or pattern to be inked in several colors. A further blanket cylinder 9 mounted in the main frame is in turn in contact with the plate cylinder 8 and interacts with three selective color inking cylinders 10 carrying selective color inking plates, also called color contour plates. These selective color inking plates have cut-out reliefs with contours corresponding to the regions of the collect printing plate of the plate cylinder 8 which are to be inked with a specific color, and are themselves each inked with the respective color by means of an inking unit 11. The selective color inking cylinders 10 are also called cut-out rollers. The blanket cylinder 9 functioning as an ink collect cylinder collects the individual inks coming from the selective color inking cylinders 10 and transfers them to the collect printing plate of the plate cylinder 8. The multicolor pattern is transferred from the plate cylinder 8 inked in this way to the blanket cylinder 2 and from the latter onto one side of the paper.

The process by which the above-described arrangement works is in general called the collect printing process or the "Orlof" process and provides a multicolor pattern, in which the individual colors are located next to one another and a complete register between the various colors of the pattern is guaranteed. Since the selective color inking plates are in contact with the elastic surface of the blanket cylinder 9, they can be produced from a hard material, and this makes it possible to cut out very fine relief zones and consequently very fine color regions, for example in the form of lines or dots.

In the example under consideration, the blanket cylinder 9 is located approximately vertically above the blanket cylinder 2 and is offset laterally only in such a way that it does not touch the paper web P running vertically upwards. The advantage of the arrangement of the three blanket cylinders 1, 2 and 9 is that, on the one hand, they are easily accessible and, on the other hand, along the periphery of the blanket cylinder 2 there is a large amount of free space for arranging further plate cylinders inking this blanket cylinder 2. In the example under consideration, there are three offset plate cylinders 12 provided, which are each inked by an inking unit 13 and of which the upper two plate cylinders 12 carry dry offset plates, whilst the lower plate cylinder 12 in turn carries a damp offset plate, preferably a gravure plate, which is dampened by means of a damping unit 14.

Arranged between the two blanket cylinders 2 and 9 at a distance from the plate cylinder 8 is a further plate cylinder 16 which is mounted in the main frame so as to be convertible and adjustable, in such a way that, in a first working position, it rests against the blanket cylinder 2, as represented by an unbroken line in the FIGURE, and, in a second working position, rests against the blanket cylinder 9, as represented by a dot-and-dash line. In the first case when the plate cylinder 16 interacts with the blanket cylinder 2, it carries an offset plate, and in the second case when it interacts with the blanket cylinder 9 it carries a selective color inking plate. In both cases, it is inked with a specific color by the inking unit 15 assigned to it.

Like the three blanket cylinders 1, 2 and 9, all the plate cylinders are mounted in the main frame of the machine, whereas the inking units 6, assigned to the plate cylinders 5, and the damping unit 7 are installed in a retractable inking carriage 18 on one side, and all the other inking units 11, 13 and 15 and the damping unit 14 are installed in a retractable inking carriage 17 on the other side.

In the example under consideration, a four-color offset print is made on one side of the paper by means of the blanket cylinder 1, and simultaneously a seven-color print is made on the other side of the paper by means of the blanket cylinder 2, and this is a combined collect print and offset print. When the plate cylinder 16 carries an offset printing plate and rests against the blanket cylinder 2, there is the combination of a three-color collect print and a four-color offset print; in the other case when the plate cylinder 16 carries a selective color inking plate and rests against the blanket cylinder 9, the combination of a four-color collect print and a three-color offset print is obtained. The adjustable and convertible plate cylinder 16 thus makes it possible to achieve very interesting combination printing possibilities, this being particularly important in banknote printing.

Where banknote printing is concerned, in particular a four-color safety background can be produced on one side and a seven-color safety background produced on the other side, this being especially secure against counterfeiting because of the seven-color pattern made by means of two completely different printing processes. On the other hand, the abovementioned gravure plates, located on the bottom-most plate cylinder 5 and the bottom-most plate cylinder 12, can be used to print a main single-color pattern on each side of the paper, whilst all the other plate cylinders simultaneously provide a multicolor safety background. In this case, therefore, the printing machine described can carry out complete banknote printing on both sides, as is particularly suitable for banknotes of relatively low values, in which the main pattern can generally be single-color. To obtain a multicolor main pattern, the paper is subsequently printed in a further printing unit, in particular a gravure printing unit.

In the example under consideration, the diameter of the blanket cylinders 1, 2 and 9 and the diameter of the plate cylinders 5, 8, 10, 12 and 16 are in the ratio 3:1, thus providing sufficient space on the periphery of the blanket cylinders to accommodate the abovementioned number of plate cylinders. Of course, the diameter ratio mentioned can also be lower, for example 2:1, or higher, for example 4:1, in which case the maximum number of plate cylinders to be accommodated changes accordingly. Also, the arrangement of the blanket cylinders 1, 2 and 9 can be different from that described. Finally, the printing machine described can also be a sheet-fed printing machine, in which case appropriate sheet guide members and, on one of the blanket cylinders 1 or 2, known sheet grabs are provided.

It is possible, furthermore, for the blanket cylinder 1 to be combined with a collect printing unit, consisting of a collect printing plate cylinder, a further blanket cylinder and selective color inking cylinders inking the latter, and with a convertible and adjustable plate cylinder similar to the plate cylinder 16, so that the side of the paper on the left in the FIGURE likewise receives a combined collect print and offset print. In particular, the left-hand side of the printing machine can then be designed completely symmetrically relative to the righthand side.

I claim:

1. A rotary multicolor printing machine for simultaneous recto-verso printing, especially for printing the safety background on backnotes, having a first blanket cylinder (1) in contact with several offset plate cylinders (5) each inked by a particular inking unit (6), a second blanket cylinder (9) in contact with several selective color inking cylinders (10) each inked by a particular inking unit (11), said second blanket cylinder also being in contact with a plate cylinder (8), a collect printing plate carried by said plate cylinder, and a third blanket cylinder (2) pressed agaonst said first blanket cylinder (1) said third blanket cylinder resting against said plate cylinder (8) carrying said collect printing plate, said first and third blanket cylinders (1,2) forming a nip for paper (p) which is to be printed on both sides and which runs through said nip between said blanket cylinders, said third blanket cylinder (2) also being in contact with several offset plate cylinders (12) each inked by a particular inking unit (13), and a further plate cylinder (16) arranged between said second and third blanket cylinders (9,2) said further plate cylinder (16) being linked by an inking unit (15) and being convertible so as to be settable in either of two different working positions, said further plate cylinder in one working position resting against said third blanket cylinder (2) and being moved away from said second blanket cylinder (9) and in the other working position resting against said second blanket cylinder (9) and being moved away from said third blanket cylinder (2).

2. A rotary multicolor printing machine as claimed in claim 1, wherein said first and third blanket cylinders (1,2) are arranged horizontally next to one another, and said second blanket cylinder (9) is arranged at least approximately vertically above said third blanket cylinder.

3. A rotary multicolor printing machine as claimed in claim 1, wherein said further plate cylinder (16), in its position resting against said third blanket cylinder (2), carries an offset printing plate and, in its possition resting against said second blanket cylinder (9) carries a selective color inking plate.

* * * * *